US007636536B2

(12) United States Patent
Iwata et al.

(10) Patent No.: US 7,636,536 B2
(45) Date of Patent: Dec. 22, 2009

(54) IMAGE FORMING APPARATUS HAVING AN IMPROVED DEVELOPER CONVEYING SYSTEM

(75) Inventors: Nobuo Iwata, Sagamihara (JP); Junichi Matsumoto, Yokohama (JP); Tomoyuki Ichikawa, Kawasaki (JP); Natsumi Katoh, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 299 days.

(21) Appl. No.: 11/516,659

(22) Filed: Sep. 7, 2006

(65) Prior Publication Data

US 2007/0053723 A1 Mar. 8, 2007

(30) Foreign Application Priority Data

Sep. 7, 2005 (JP) ..... 2005-258644
Jun. 22, 2006 (JP) ..... 2006-172536

(51) Int. Cl.
*G03G 15/08* (2006.01)

(52) U.S. Cl. ..... 399/256; 399/258

(58) Field of Classification Search ..... 399/258–260, 399/255, 256
See application file for complete search history.

(56) References Cited

U.S. PATENT DOCUMENTS 3,983,841 A * 10/1976 Norton
4,367,954 A * 1/1983 Ganz et al.
5,467,175 A 11/1995 Takagaki et al.
5,659,870 A * 8/1997 Takahara et al.
5,682,584 A * 10/1997 Hattori et al. ..... 399/255
6,163,669 A 12/2000 Aoki et al.
6,295,437 B1 9/2001 Hodoshima et al.
6,608,984 B1 8/2003 Matsumoto et al.
6,628,913 B2 9/2003 Matsumoto et al.
6,816,695 B2 11/2004 Nakai et al.
7,043,178 B1 * 5/2006 Taylor et al. ..... 399/256
7,050,744 B2 * 5/2006 Tamura et al. ..... 399/258
7,082,274 B2 * 7/2006 Saitoh et al.
7,103,305 B2 9/2006 Koike et al.
7,149,461 B2 * 12/2006 Tamura et al. ..... 399/258
7,167,668 B2 * 1/2007 Sekiguchi ..... 399/258
7,263,325 B2 * 8/2007 Marin et al. ..... 399/256
7,409,180 B2 * 8/2008 Seo ..... 399/258

(Continued)

FOREIGN PATENT DOCUMENTS

JP 06208320 A * 7/1994

(Continued)

OTHER PUBLICATIONS

U.S. Appl. No. 07/284,359, filed Dec. 14, 1988.

(Continued)

*Primary Examiner*—Susan S Lee
(74) *Attorney, Agent, or Firm*—Oblon, Spivak, McClelland, Maier & Neustadt, L.L.P.

(57) ABSTRACT

An image forming apparatus includes a conveying pipe configured to convey a developer and a magnetic field generation mechanism configured to generate a magnetic field inside the conveying pipe to affect the developer. The magnet is formed to have lower magnetic intensities at positions upstream and downstream from a middle position of the conveying pipe along a conveying direction of the conveying pipe than a magnetic intensity in the middle of the conveying pipe.

15 Claims, 6 Drawing Sheets

U.S. PATENT DOCUMENTS

| | | | | |
|---|---|---|---|---|
| 2002/0186988 | A1* | 12/2002 | Abramsohn | 399/256 |
| 2004/0258434 | A1* | 12/2004 | Yoshizaki et al. | 399/258 |
| 2005/0163537 | A1 | 7/2005 | Muramatsu et al. | |
| 2005/0196180 | A1* | 9/2005 | Harumoto | |
| 2005/0265759 | A1 | 12/2005 | Takeuchi et al. | |
| 2005/0281592 | A1 | 12/2005 | Muramatsu et al. | |
| 2006/0008281 | A1 | 1/2006 | Matsumoto et al. | |
| 2007/0053721 | A1 | 3/2007 | Matsumoto et al. | |
| 2007/0098449 | A1* | 5/2007 | Kadota et al. | 399/258 |
| 2007/0253745 | A1* | 11/2007 | Maruyama | 399/258 |

FOREIGN PATENT DOCUMENTS

| | | | |
|---|---|---|---|
| JP | 07061593 | A * | 3/1995 |
| JP | 07185389 | A * | 7/1995 |
| JP | 08-334976 | | 12/1996 |
| JP | 11352857 | A * | 12/1999 |
| JP | 2001-183893 | | 7/2001 |
| JP | 2001-194860 | | 7/2001 |
| JP | 2002214909 | A * | 7/2002 |
| JP | 2003-029514 | | 1/2003 |

OTHER PUBLICATIONS

U.S. Appl. No. 07/729,850, filed Jul. 11, 1991, Iwata, et al.
U.S. Appl. No. 11/227,566, filed Sep. 16, 2005, Nagatomo, et al.
U.S. Appl. No. 12/048,705, filed Mar. 14, 2008, Iwata, et al.
U.S. Appl. No. 11/751,163, filed May 21, 2007, Katoh, et al.
U.S. Appl. No. 12/126,441, filed May 23, 2008, Matsumoto, et al.
U.S. Appl. No. 12/129,961, filed May 30, 2008, Katoh, et al.
U.S. Appl. No. 12/130,092, filed May 30, 2008, Ohmura, et al.
U.S. Appl. No. 12/256,998, filed Oct. 23, 2008, Iwata et al.
U.S. Appl. No. 12/178,986, filed Jul. 24, 2008, Matsumoto, et al.

* cited by examiner

IMAGE FORMING APPARATUS HAVING AN IMPROVED DEVELOPER CONVEYING SYSTEM

This patent application is based on Japanese patent applications No. 2005-258644 filed on Sep. 7, 2005 and No. 2006-172536 filed on Jun. 22, 2006 in the Japan Patent Office, the entire contents of which are incorporated by reference herein.

BACKGROUND OF THE INVENTION

1. Field of the Invention

The present invention relates to an image forming apparatus, and more particularly to an image forming apparatus which is capable of stably and efficiently conveying a developer along an inclined conveying pipe.

2. Discussion of the Background

Background image forming apparatuses, such as printers, facsimiles, copiers, and multifunction apparatuses which print, fax, copy, and so on generally use an electrophotographic process for image forming. Such background image forming apparatus includes a development unit which employs a trickle development method to supply a new carrier.

Using the trickle development method, the new carrier is supplied by a necessary amount to the development unit, which stores a two-component developer including toner and the carrier. The toner is supplied from a toner compensating port into the development unit by the necessary amount in accordance with the consumption of the toner in the development unit. The toner compensating port is arranged at a portion of the development unit.

The supplied toner is stirred and mixed with the developer in the development unit by stirring members such as a conveying screw and so on. After the developer is stirred and mixed, a part of the developer is then supplied to a development roller. The developer held on the development roller is controlled to be a necessary amount by a doctor blade. The toner, which is one component of the two-component developer, is adhered on a latent image formed on a photosensitive drum at a position at which the photosensitive drum faces the development roller.

In a common development process, the carrier, which is another component of the two-component developer, is not consumed and remains in the development unit. Therefore, the carrier deteriorates in time. More specifically, a charging ability of the carrier may be decreased because a coating layer of the carrier is worn off or is peeled off while the carrier has been stirred or mixed during repeated processes for a long period (film peeling phenomenon). Further, the charging ability of the carrier may be decreased because toner elements and additives are adhered onto the surface of the carrier (spent phenomenon).

The trickle development method is employed to avoid the image degradation due to such carrier deterioration in time. Namely, the new carrier (or new two-component developer) is supplied when it is necessary and a part of the new two-component developer in the development unit is output from the development unit as appropriate. The charging ability of the carrier is then maintained and the amount of the carrier stored in the development unit is maintained constant by reducing the portion of the deteriorated carrier in the development unit.

The image forming apparatus using the trickle development method can produce a high quality image for a longer usage comparing to an image forming apparatus in which the development unit and the carrier are exchanged with the new development unit and the new carrier only when the degradation of the carrier is detected.

An image forming apparatus includes a coil screw in a conveying path from a carrier storage to the development unit. More specifically, the coil screw is arranged inside a hollow pipe connecting a carrier source to a carrier target arranged separately from each other. The carrier is conveyed by a mechanical force generated by a drive rotation of the coil screw. Further, the carrier may be conveyed by a screw pump through a carrier conveying path formed with a tube having a flexible shape.

In such image forming apparatus, the carrier may slip through an interspace between the hollow pipe and the coil screw. The conveying amount of the carrier may be small, especially in the case where the conveying path is inclined and the carrier is conveyed from a lower position to a higher position against the gravitational force.

Even when the image forming apparatus uses an-air pump to convey the carrier through the inclined path against gravity, a conveying failure may still occur because a specific gravity of the carrier is larger than a specific gravity of the toner. As a result, a strong and large pump requiring a high power may be needed.

SUMMARY OF THE INVENTION

This patent application describes a novel image forming apparatus which includes a conveying pipe configured to convey a developer, and a magnetic field generation mechanism configured to generate a magnetic field inside the conveying pipe to affect the developer.

An embodiment of the present invention describes a novel image forming apparatus which includes a spiral member arranged in the conveying pipe and configured to be rotated in accordance with a rotation of the conveying pipe.

Further, another embodiment of the present invention describes a novel image forming apparatus in which the magnetic field generation mechanism is formed to have a lower magnetic intensity at an upstream and downstream along a conveying direction of the carrier conveying pipe than a magnetic intensity in the middle of the carrier conveying pipe.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
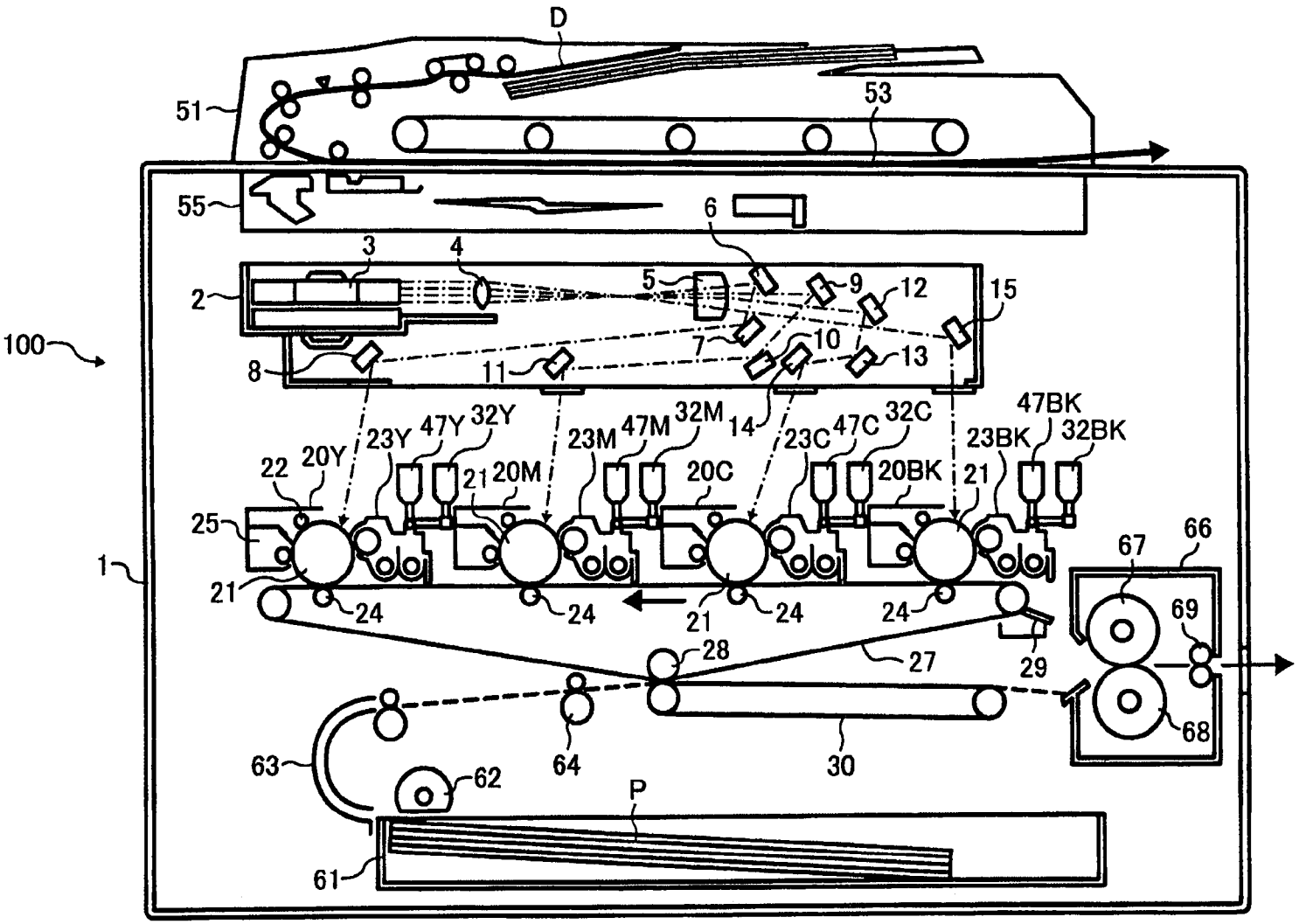
FIG. 1 illustrates an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus 100 according to an embodiment of the present invention is described.

FIG. 1 illustrates an image forming apparatus 100 according to an embodiment of the present invention. In FIG. 1, a color copier is shown as an example of the image forming apparatus. As illustrated in FIG. 1, the image forming apparatus 100 includes a main body 1, a writing unit 2, color process cartridges 20Y, 20M, 20C and 20 BK, photosensitive drums 21, charging units 22, developing units 23Y, 23M, 23C and 23 BK, transfer bias rollers 24, cleaning units 25 and an intermediate transfer belt 27.

The writing unit 2 emits a laser light in accordance with input image information. Each color process cartridge 20Y, 20M, 20C and 20 BK performs corresponding color processing. The photosensitive drum 21 is an image carrier and is arranged in the corresponding color process cartridge 20Y, 20M, 20C and 20 BK. The charging unit 22 charges a surface of the photosensitive drum 21. The developing unit 23Y, 23M, 23C and 23BK develops an electrostatic latent image formed on the photosensitive drum 21.

The transfer bias roller 24 transfers a toner image formed on the photosensitive drum 21 to the intermediate transfer belt 27. The cleaning unit 25 collects residual toner which is not transferred and is adhered on the photosensitive drum 21. A plurality of the toner images are transferred on the intermediate transfer belt 27 by superimposing one after another.

Further, the image forming apparatus 100 includes a secondary transfer bias roller 28, an intermediate transfer belt cleaning unit 29, a conveying belt 30, toner supply units 32Y, 32M, 32C and 32BK, carrier supply units 47Y, 47M, 47C and 47BK, a document conveyer 51, a document reader 55, a paper supply unit 61 and a fixing unit 66.

The secondary transfer bias roller 28 transfers the toner image formed on the intermediate transfer belt 27 to a recording medium P. The intermediate transfer belt cleaning unit 29 collects residual toner which is not transferred and is adhered on the intermediate transfer belt 27. The conveying belt 30 conveys the recording medium P on which four color toner images are transferred.

The toner supply unit 32Y, 32M, 32C and 32BK supplies each color toner to the corresponding developing unit 23Y, 23M, 23C and 23BK. The carrier supply unit 47Y, 47M, 47C and 47BK supplies the carrier to the developing units 23Y, 23M, 23C and 23BK. The document conveyer 51 conveys a document D to the document reader 55. The document reader 55 (scanner) reads image information of the document D. The paper supply unit 61 stores the recording medium P, for example, transfer paper and so on. The fixing unit 66 fixes the image on the recording medium P.

The photosensitive drum 21, the charging unit 22 and the cleaning unit 25 are included/integrated in each process cartridge 20Y, 20M, 20C and 20BK. Each color (yellow, magenta, cyan and black) image is formed on the photosensitive drum 21 of each process cartridge 20Y, 20M, 20C and 20 BK.

An operation of the common color image forming processing will be next described. The document D is conveyed from a document table in a direction shown by an arrow in FIG. 1 by the conveying roller of the document conveyer 51. The document D is placed on a contact glass 53 of the document reader 55. Image information of the document D is read optically at the document reader 55.

More specifically, the document reader 55 reads the image information by exposing the document D with a light emitted from a lamp and scanning the document D with the emitted light. The light is reflected from the document D and is provided on a color sensor via a plurality of mirrors and lenses to form an image.

The color image information of the document D is read by each RGB (read, green, blue) color element of the color sensor and is converted to each electric color image signal. At an image processing unit (not shown), color data conversion, color calibration, spatial frequency calibration and so on are performed based on each electric color image signal so as to obtain yellow, magenta, cyan and black color image information.

Each color image information, yellow, magenta, cyan and black, is transmitted to the writing unit 2. At the writing unit 2, a laser beam is exposed to each photosensitive drum 21 of the corresponding process cartridge 20Y, 20M, 20C and 20BK in accordance with each color image information.

Each photosensitive drum 21 is rotated in a clockwise direction in FIG. 1. The surface of the photosensitive drum 21 is charged uniformly at a position where the photosensitive drum faces the charging unit 22 (charging process). Thus, a predetermined potential is set on the surface of the photosensitive drum 21. The surface of the photosensitive drum 21 is moved/rotated further to a position to be exposed by the laser beam.

The corresponding laser light is exposed from the light source based on the corresponding image signal. The laser beam is input to and reflected from a polygon mirror 3. The laser beam passes through the lenses 4 and 5. After passing through the lenses 4 and 5, the laser light for each color goes though individual paths (exposure process).

The laser beam corresponding to the yellow color is reflected by mirrors 6 to 8 and is exposed on the surface of the photosensitive drum 21 arranged in the first left process cartridge 20Y in FIG. 1. The laser beam for the yellow color is scanned by the polygon mirror 3 rotating with high speed in a direction of rotation shaft of the photosensitive drum 21. An electrostatic latent image corresponding to the yellow color is formed on the surface of the photosensitive drum 21 which is charged at the charging unit 22.

Similarly, the laser beam corresponding to the magenta color is reflected by mirrors 9 to 11 and is exposed on the surface of the photosensitive drum 21 arranged at the second process cartridge 20M from the left of the series of the process cartridges. An electrostatic latent image corresponding to the magenta color is formed on the surface of the photosensitive drum 21.

The laser beam corresponding to the cyan color is reflected by mirrors 12 to 14 and is exposed on the surface of the photosensitive drum 21 arranged at the third process cartridge 20C from the left of the series of the process cartridges. An electrostatic latent image corresponding to the cyan color is formed on the surface of the photosensitive drum 21.

The laser beam corresponding to the black color is reflected by mirror 15 and is exposed on the surface of the photosensitive drum 21 arranged at the fourth process cartridge 20BK from the left of the series of the process cartridges. An electrostatic latent image corresponding to the black color is formed on the surface of the photosensitive drum 21.

The surface of the photosensitive drum 21, on which each electrostatic latent image is formed, is moved further to a position where the photosensitive drum faces the development unit 23Y, 23M, 23C and 23BK. Each color toner is supplied onto the photosensitive drum 21 from the development unit 23Y, 23M, 23C and 23BK. The electrostatic latent image on the photosensitive drum 21 is developed (development process).

The developed surface of the photosensitive drum 21 is moved further to a position where the developed surface faces the intermediate transfer belt 27. At this position, a transfer bias roller 24 is arranged at an inner side of the intermediate transfer belt 27 to touch the intermediate transfer belt 27. At a position of the transfer bias roller 24, each color image formed on the photosensitive drum 21 is transferred onto the intermediate transfer belt 27 by superimposing one after another (first transfer process).

After the first transfer process, the surface of the photosensitive drum 21 is moved further to a position where the photosensitive drum faces the cleaning unit 25. At the cleaning unit 25, a residual toner on the photosensitive drum 21, which is not transferred, is corrected/removed (cleaning process). Further, the surface of the photosensitive drum 21 passes through a removing-electricity unit (not shown). A series of image forming processes performed at the photosensitive drum 21 has been completed.

Meanwhile, the surface of the intermediate transfer belt 27, on which each color image is transferred, is moved in a direction shown by an arrow to a position of a secondary transfer bias roller 28. At the position of the secondary transfer bias roller 28, the full color image formed on the intermediate transfer belt 27 is transferred onto a recording medium P (secondary transfer process).

The surface of the intermediate transfer belt 27 is moved further to a position of an intermediate-transfer-belt cleaning unit 29. Residual toner on the intermediate transfer belt 27, which is not transferred, is corrected/removed by the intermediate-transfer-belt cleaning unit 29 (cleaning process). A series of image forming processes performed on the intermediate transfer belt 27 has been completed.

Meanwhile, the recording medium P at the secondary transfer bias roller 28 is conveyed from a paper supply unit 61 via a conveying guide 63, a resist roller 64 and so on. More specifically, the recording medium P is drawn out from the paper supply unit 61 by a paper supply roller 62. The recording medium P is carried to the resist roller 64 via the conveying guide 63. The recording medium P is further conveyed to the position of the secondary transfer bias roller 28 with a predetermined timing to match the timing of toner image held on the intermediate transfer belt 27.

After the full color image is transferred onto the recording medium P, the recording medium P is carried to the fixing unit 66 by a conveying belt 30. At the fixing unit 66, the full color image is fixed on the recording medium P by a nip formed with a heating roller 67 and a pressuring roller 68. After fixing, the recording medium P is output from the main body 1 by paper-output rollers 69. Thus, a series of image forming processes has been completed.

Figure 2:
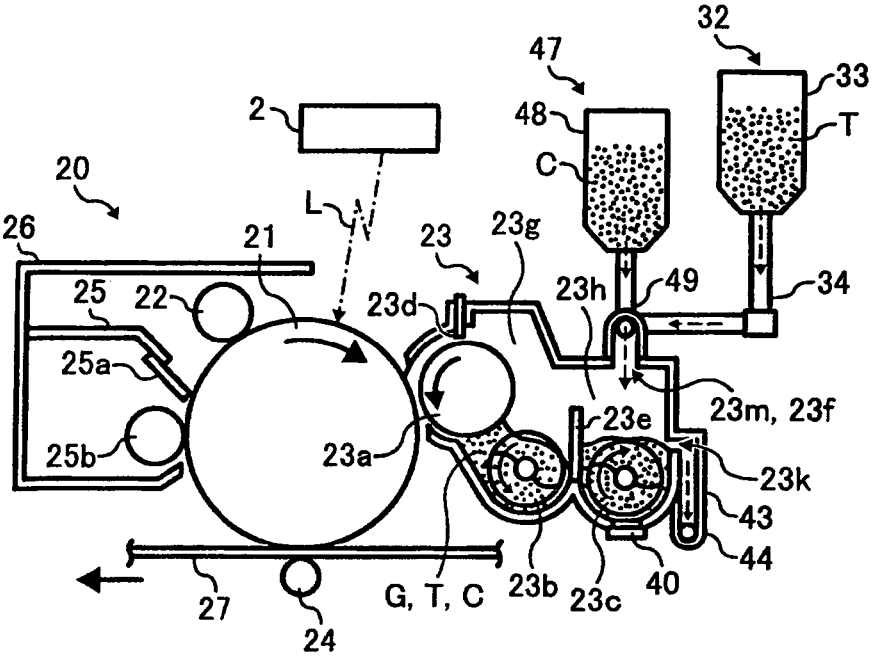
FIG. 2 illustrates a cross sectional view of an image forming unit.
Figure 3:
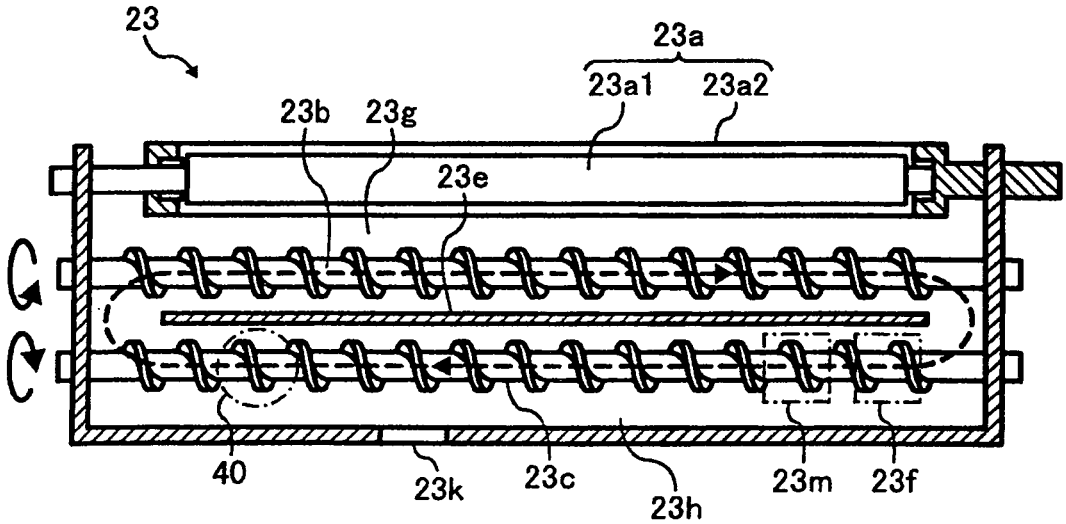
FIG. 3 illustrates a cross sectional view of a development unit of the image forming unit in a longitudinal direction.

Referring to FIGS. 2 and 3, the image forming unit of the image forming apparatus will be described. FIG. 2 illustrates a cross sectional view of the image forming unit. FIG. 3 illustrates a cross sectional view of a development unit of the image forming unit in a longitudinal direction.

The four image forming units are arranged in the main body 1. Each image forming unit for each color (Yellow, cyan, magenta and black) has a similar structure and includes a process cartridge 20, a development unit 23 and a toner supply unit 47. The process cartridge 20 includes a photosensitive drum 21 as an image carrier, a charging unit 22 and a cleaning unit 25 which are integrated in a case 26. The cleaning unit 25 includes a cleaning blade 25*a* and a cleaning roller 25*b* which contact with the photosensitive drum 21.

The development unit 23 includes a development roller 23*a*, a first conveying screw 23*b*, a second conveying screw 23*c* and a doctor blade 23*d*. The development roller 23*a* is arranged to face the photosensitive drum 21 and the first conveying screw 23*b* is arranged to face the development roller 23*a*. The second conveying screw 23*c* is arranged to face the first conveying screw 23*b* via a dividing member 23*e*. The doctor blade 23*d* is arranged to face the development roller 23*a*.

Further, the development unit 23 includes a first developer storage 23*g* and a second developer storage 23*h*, which are separated by the dividing member 23*e*. The first developer storage 23*g* and the second developer storage 23*h* form a circular flow path of the developer. The developer flows circularly through both ends of the developer storages 23*g* and 23*h* in the longitudinal direction as shown by a dotted arrow in FIG. 3. The first developer storage 23*g* includes the development roller 23*a*, the first conveying screw 23*b* and the doctor blade 23*d*. The second developer storage 23*h* includes the second conveying screw 23*c* and a magnetic sensor 40.

Referring to FIG. 3, the development roller 23*a* includes a magnet 23*a*1 and a sleeve 23*a*2. The magnet 23*a*1 is fixedly arranged inside of the development roller 23*a* to form magnetic poles on the circumferential surface of the development roller 23*a*. The sleeve 23*a*2 is formed of nonmagnetic material and is configured to rotate around the circumference of the magnet 23*a*1. A plurality of the magnetic poles such as a main pole, a conveying pole, a drawing pole, an agent-isolation pole and so on are formed on the development roller 23*a* (the sleeve 23*a*2) by the magnet 23*a*1.

The development roller 23*a* (the sleeve 23*a*2) is coupled to a drive motor (not shown) arranged in the main body 1 to be rotated by the drive motor. The development roller 23*a* is coupled to the conveying screws 23*b* and 23*c* by a series of gears. The development roller 23*a* is rotated by the drive motor. The conveying screws 23*b* and 23*c* are driven to be rotated in accordance with the rotation of the development roller 23*a*.

In the developing unit 23, a two-component developer G which includes toner T and carrier C is stored. More specifically, the toner T may be the toner of the two-component developer G and may also be the toner of the toner supply unit 32. The toner T includes toner base particles formed of a resin and an additive agent formed of a coloring agent.

The toner T may be manufactured using a plurality of manufacturing methods, for example, a composition method, a fine particle formation method and a mixing-adhesive method. The composition method uses polymerization reactions such as an emulsion polymerization and a suspension polymerization utilizing monomer. In the fine particle formation method, a resin material is melted by heat and is sprayed to form the fine particles. In the mixing-adhesive method using a Henschel mixer and so on, the additive agent is mixed and is attached to the toner base particles having a predetermined size. The toner base particles are obtained by dispersion into water and so on.

Resin materials to be included in the toner T will be listed. The resin material is used solely, or the mixture of more than one material will be used.

As polymers of styrene series and the derivative substitution of the styrene series, for example, polystyrene, polychlorostyrene, and polyvinyltoluene may be used.

As copolymers of Styrene series, for example, copolymer of Styrene and p-chlorostyrene, copolymer of Styrene and propylene, copolymer of Styrene and vinyltoluene, copolymer of Styrene and vinylnaphthalene, copolymer of Styrene and methyl acrylate, copolymer of Styrene and ethyl acrylate, copolymer of Styrene and butyl acrylate, copolymer of Styrene and octyl acrylate, copolymer of Styrene and methyl methacrylate, copolymer of Styrene and ethyl methacrylate, copolymer of Styrene and butyl methacrylate, copolymer of Styrene and methyl α-chlormethacrylate, copolymer of Styrene and acrylonitrile, copolymer of Styrene and vinylmethylether, copolymer of Styrene and vinylethylether, copolymer of Styrene and vinylmethylketone, copolymer of Styrene and butadiene, copolymer of Styrene and isoprene, copolymer of Styrene, acrylonitrile and indene, copolymer of Styrene and maleic acid, copolymer of Styrene and maleate and so on may be used.

Further, polymethyl methacrylate, poly methyl methacrylate, polyvinyl chloride, polyvinyl acetate, polyethylene, polypropylene, polyester, polyvinylbutylbutyral, polyacrylic resin, rosin, modified rosin, terpene resin, phenol resin, aliphatic or alicyclic hydrocarbon resin, romatic system petroleum resin, chlorinated paraffin and paraffin wax may be used as the resin material.

As the coloring agent for black color in the toner T, carbon black, aniline black, furnace black, lampblack and so on may be used. As the coloring agent for cyan color in the toner T, phthalocyanine blue, methylene blue, Victoria blue, methyl violet, aniline blue, ltramarine and so on may be used.

As the coloring agent for magenta color in the toner. T, rhodamine 6G lake, dimethylquinacridone, watching red, rose Bengal, rhodamine B, alizarine lake and so on may be used. As the coloring agent for yellow color in the toner T, chrome yellow, benzidine yellow, Hansa yellow, naphthol yellow, molybdenum orange, quinoline yellow, tartrazine and so on may be used.

The toner T may includes a charging-acceleration agent with a small amount to charge efficiently. As the charging-acceleration agents, for example, facial wash, polarity control agent and so on may be used. As the polarity control agent, metal complex monoazo dyestuff, nitrohumic acid, sodium of the nitrohumic acid, salicylic acid, naphthoic acid, sodium of Co, Cr and Fe of metal complex dicarboxylic acid, organic dyestuff, class-4-ammonium salt and so may be used.

As the inorganic fine particle for the additive agent, silica, alumina, titanium oxide, barium titanate, magnesium titanate, calcium titanate, strontium titanate, iron oxide, copper oxide, zinc oxide, tin oxide, silica sand, clay, mica, sand-lime stone, diatomite, chrome oxide, cerium oxide, angle plate, antimony trioxide, magnesium oxide, zirconium oxide, pallium sulfate, barium carbonate, calcium carbonate, silicon carbide, silicon nitride and so on may be used.

When silica or titanium oxide is used, it is possible to efficiently obtain two effects, i.e., a suppression effect and a stabilization effect. The suppression effect is to inhibit the additive agent to be sinking under the toner and the stabilization effect is to stably charge the toner.

The carrier C includes a core particle and a magnetic coating layer formed on the core particle. More specifically, the carrier C may be the carrier of the two component developer G and may be the carrier in the carrier cartridge 48.

As the core particle of the carrier C, ferromagnetic metals such as iron, cobalt, nickel, etc. and alloyed metals or compounds of the alloyed metals such as magnetite, hematite, ferrite and so on may be used.

As for the resin material to form the magnetic coating layer, polyolefin resins, for example, polyethylene, polypropylene, chlorinated polyethylene, chlorosulfonated polyethylene, etc. may be used. Further, polyvinyl, polyvinylidene series resins, for example, polystyrene, acrylate resin (such as polymethyl methacrylate), polyacrylonitrile, polyvinyl acetate, polyvinyl alcohol, polyvinyl butyral, polyvinyl chloride, polyvinyl carbazole, polyvinyl ether, polyvinyl ketone, copolymer of polyvinyl-chloride and vinyl acetate and copolymer of styrene and acrylic acid may be used.

Further, silicone resin such as straight silicone resin with organosiloxane bond and the modifications, for example, modifications of alkyd resin, polyester, epoxy resin may be used. Moreover, fluorocarbon resins, for example, polytetrafluoroethylene, polyfluoroethylene, polyfluorovinylidene, polychlorotryfluoroethylene are used. Furthermore, polyamide, polyester such as polyethylene terephthalate, polyurethane, polycarbonate, amino resin such as urea resin, formaldehyde resins, epoxy resin, etc. may be used.

Among the resins, the acrylate resin, the silicone resin, the modifications of the acrylate resin and the silicone resin and fluorocarbon resin are suitable materials to avoid the toner spent phenomenon. Especially, the silicone and the modifications of the silicone are suitable materials.

To form the covering layer, the resin is coated on the surface of the carrier core particles by a spraying method, dipping method, etc. The fine particles may be doped into the covering layer of the carrier to control the carrier resistance. A fine particle with the size of 0.01 to 5.0 um may be dispersed in the covering layer. Optimally, the fine particle of 2 to 30 weight may be doped to the covering layer resin of 100 weight. As the fine particle, metal oxides such as silica, alumina, titania, etc. and pigments such as carbon black, etc. may be used.

The development process in the image forming process will be next described in more detail. The development roller 23*a* is rotated in a direction shown by an arrow in FIG. 2. The developer G in the development unit 23 is mixed with the toner T (new toner) supplied from the toner supply unit 32 through a toner compensating port 23*f* and is circulated in a longitudinal direction (as shown by an arrow with a dotted in FIG. 3) by the rotation of the first and second conveying screws 23*b* and 23*c* (as shown by an arrow with a solid line in FIG. 3).

The dividing plate 23*e* is arranged between the first and second conveying screws 23*b* and 23*c* to separate them. The first conveying screw 23*b* conveys the developer G to the right direction in FIG. 3 and the second conveying screw 23*c* conveys the developer G to the left direction in FIG. 3.

The toner is charged by friction and is adhered on the carrier C. The toner is held on the development roller 23*a* together with the carrier C as the developer G. The developer G held on the development roller 23*a* is then conveyed to a position of the doctor blade 23*d*. The developer G on the development roller 23*a* is controlled by the doctor blade 23*d* to have a predetermined amount at the position of the doctor blade 23*d*. After passing through the position of the doctor blade 23*d*, the developer G is conveyed further to a position the photosensitive drum 21 faces (development region).

At the development region, the toner T in the developer G is adhered onto the electrostatic latent image formed on the surface of the photosensitive drum 21. More specifically, the toner T is adhered by an electric field formed by the potential difference (development potential) between a latent potential (exposure potential) and a development bias (development potential). The latent potential is a potential at a position the laser beam is to be exposed. The development bias is a potential applied to the development roller 23*a*.

The toner T adhered on the photosensitive drum 21 is transferred onto the intermediate transfer belt 27. A residue of the toner T, which is not transferred, is corrected/removed into the cleaning unit 25 by the cleaning blade 25*a* and the cleaning roller 25*b*.

The toner supply unit 32 is arranged in the main body 1 and includes a toner cartridge 33 and a toner conveying mechanism. The toner cartridge 33 is configured to be exchangeable. The toner conveying mechanism conveys the new toner supplied from the toner cartridges 33 to the development unit 23.

Figure 4:
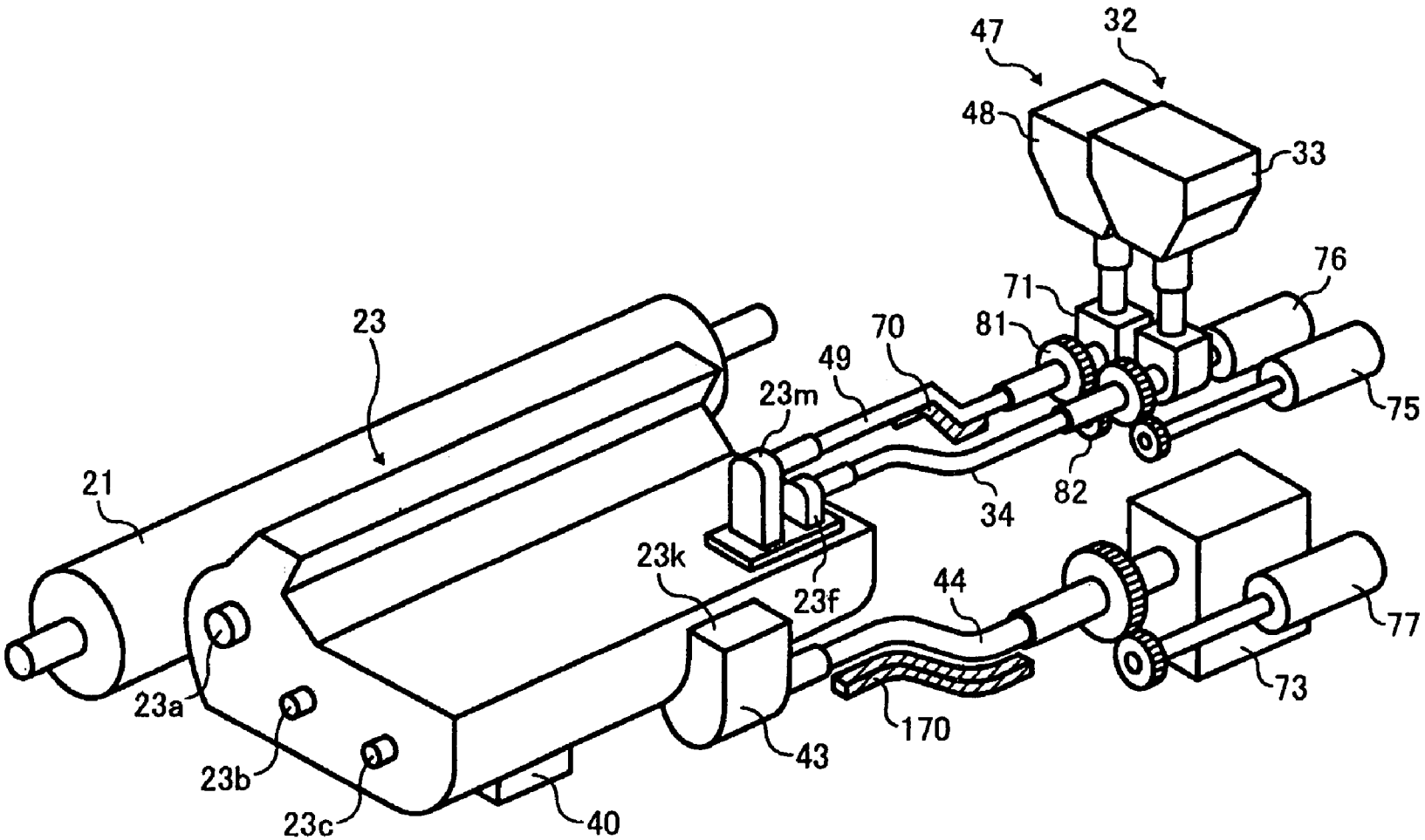
FIG. 4 illustrates an oblique perspective view of a carrier conveying mechanism.

The toner conveying mechanism includes a toner conveying pipe 34 (toner conveying path), a drive motor 75 and so on. The drive motor 75 drives to rotate the toner conveying pipe 34 as shown in FIG. 4. In the toner cartridges 33, a new color toner T (yellow, magenta, cyan and black color toner) is stored.

The toner conveying pipe 34 is formed of a flexible material such as rubber and includes a spiral fin (spiral member). The toner T is conveyed in the toner conveying pipe 34 by the rotation of the toner conveying pipe 34 and the spiral fin.

The toner T in the toner cartridge 33 is supplied into the development unit 23 from the toner compensating port 23*f* in accordance with a toner consumption of the development unit 23. The toner consumption of the development unit 23 is detected by the magnetic sensor 40 (toner-concentration detection mechanism) and a photo sensor (not shown). The magnetic sensor 40 is arranged underneath of the second conveying screw 23*c* of the development unit 23. The photo sensor is arranged to face the photosensitive drum 21.

The toner is supplied from the toner supply unit 32 to the development unit 23 via the toner compensating port 23*f* to keep the detection result detected by the magnetic sensor and the photo sensor within a predetermined range of a toner concentration. The toner concentration is a ratio of the toner T to the developer G. The toner amount to be supplied to the development unit 23 may be adjusted by controlling a driving time of the drive motor.

The development unit 23 employs a trickle development method in this exemplary embodiment. As shown in FIGS. 2 and 4, the image forming apparatus 100 includes a developer-outputting mechanism 23*k* and a carrier supply unit 47. The developer-outputting mechanism 23*k* outputs a part of the developer G out of the development unit 23. The carrier supply unit 47 supplies the new carrier to the development unit 23.

More specifically, the carrier supply unit 47 is connected to the second developer storage 23*h* in addition to the toner supply unit 32. The carrier supply unit 47 includes a carrier cartridge 48 and a carrier conveying mechanism. The carrier cartridge 48 is configured to be exchangeable. The carrier conveying mechanism works as a developer conveying mechanism which conveys the new carrier C output from the carrier cartridge 48 to the development unit 23 via a carrier compensating port 23*m*.

The carrier conveying mechanism includes a carrier conveying pipe 49 (carrier conveying path) and a drive motor 76. The drive motor 76 drives to rotate the carrier conveying pipe 49. The new carrier is stored in the carrier cartridge 48. The carrier conveying pipe 49 is a tube formed of a flexible material such as rubber and includes a spiral fin therein. The carrier is conveyed through the carrier conveying pipe 49 by the rotation of the carrier conveying pipe 49 and the spiral fin driven by the drive motor 76. The configuration of the carrier convey mechanism will be described later.

Meanwhile, at an upper part of a sidewall of the second developer storage 23*h*, a developer-outputting port 23*k* is arranged to output the developer. If the amount of the developer in the development unit 23 exceeds a predetermined amount by feeding the new developer C from the carrier supply unit 47 into the developer unit 23, the excess developer G is output from the developer unit 23 through the developer-outputting port 23*k*. The excess developer G is dropped into the developer-outputting path 43 and is conveyed to a developer correcting unit 73 by a two-component developer conveying mechanism (developer conveying mechanism).

The two-component developer conveying mechanism includes a developer conveying pipe 44 (developer conveying path) and a drive motor 77 as referred to FIG. 4. The drive motor 77 drives to rotate the developer conveying pipe 44. Waste developer will be stored in the developer correcting unit 73. The developer conveying pipe 44 is a tube formed of a flexible material such as rubber and includes a spiral fin therein. The developer is conveyed through the developer conveying pipe 44 by the rotation of the developer conveying pipe 44 and the spiral fin driven by the drive motor 77.

Thus, if a position of the top surface of the developer stored in the developer unit 23 is moved up by supplying the new carrier C, the developer G which is carried up to exceed the position of the developer-outputting port 23*k* is output from the developer unit 23. As a result, the top surface of the developer in the developer unit 23 can be kept at a constant position.

In this embodiment, the so called overflow method is used as an outputting procedure to output the developer from the development unit 23. However, other method also can be employed. For example, an openable and closable shutter may be arranged at the developer-outputting port 23*k* to control to output of the developer.

Figure 5:
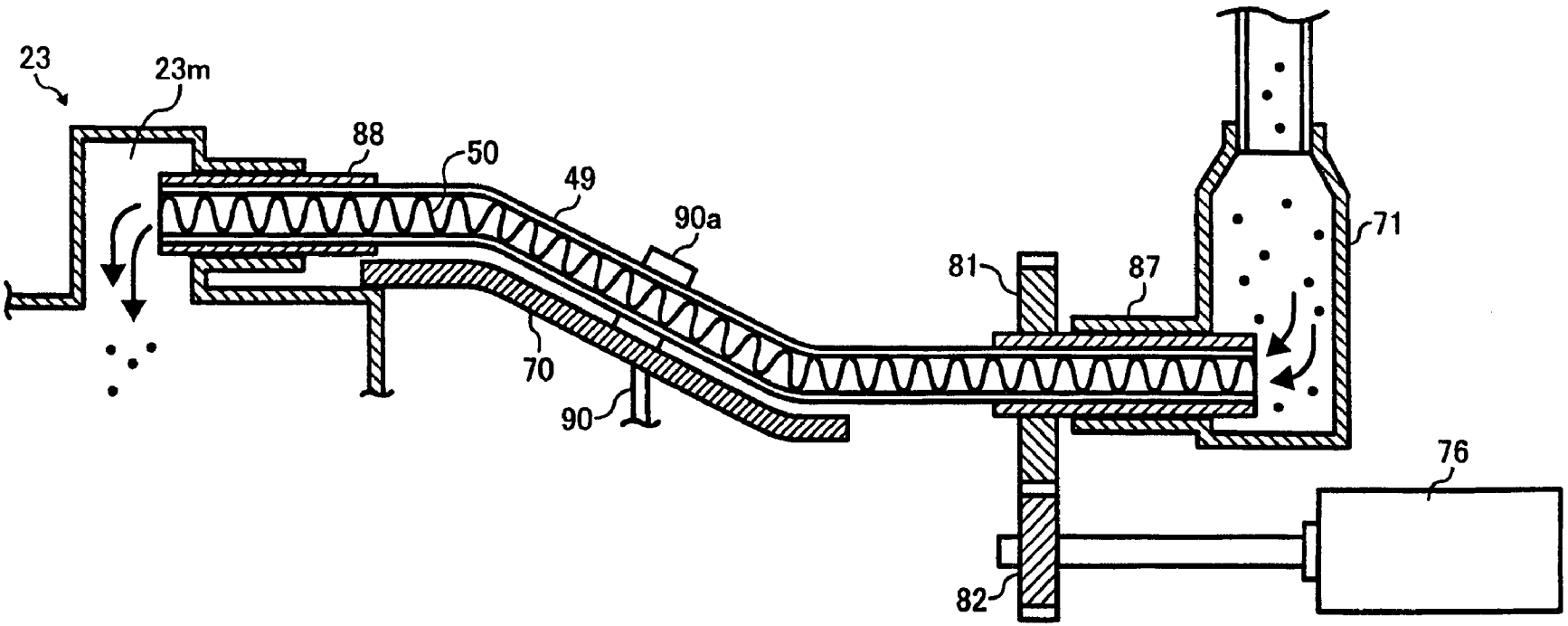
FIG. 5 illustrates a cross sectional view of the carrier conveying mechanism.

Referring to FIGS. 4 and 5, the carrier conveying mechanism will be described. The carrier conveying mechanism includes a carrier conveying pipe 49, a spiral fin 50, guide members 87 and 88, a support member 90, gears 81 and 82, a drive motor 76 and a magnet 70. The carrier conveying pipe 49 is a tube formed of a non-magnetic material which has a good flexibility and a high resistivity to toner.

Figure 6A:
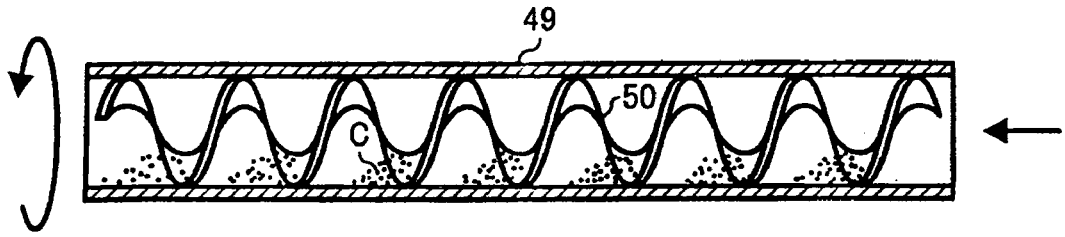
FIGS. 6A to 6D illustrate carrier conveying pipes of the carrier conveying mechanism.

FIG. 6A illustrates the carrier conveying pipe 49 of the carrier conveying mechanism. The spiral fin 50, which is an example of spiral members, is arranged at a predetermined distance from an inner circumference of the carrier conveying pipe 49. The predetermined distance may take a value between zero and five times a particle size of the carrier. The maximum distance of the predetermined distance is determined depending on an angle of the conveying pipe 49 and the material so that the carrier is not dropping through the interspace. A variety of the spiral fins, for example, a coiled thin metal formed of non-magnetic metal material and a resin coil formed of a resin material are employed.

If the carrier conveying pipe 49 and the spiral fin 50, which can be flexibly curved, are employed, a curved conveying path can be formed. It is possible to offer greater flexibility to the layout of the carrier conveying path so as to make the image forming apparatus compact. Further, if the carrier conveying pipe 49 and the spiral fin 50 are formed with non-magnetic material, a predetermined magnetic field can be formed inside the carrier conveying pipe 49 by placing the magnet 70 inside the carrier conveying pipe 49. The magnet 70 is an example of the magnetic field generator.

One end of the carrier conveying pipe 49 is connected to the carrier compensating port 23*m* of the developing unit 23. The other end of the carrier conveying pipe 49 is connected to the carrier cartridge 48 (developer storage) via a transit member 71. More specifically, the one end of the carrier conveying pipe 49 is rotatably supported by a cylindrical guide member 88 at the position of the carrier compensating port 23*m*. The other end of the carrier conveying pipe 49 is rotatably supported by a cylindrical guide member 87 at the position of the transit member 71.

The guide member 87 is integrated with a gear 81. The gear 81 is engaged with a gear 82 arranged around a shaft of the drive motor 76. Further, the carrier conveying pipe 49 is supported rotatably by a guide member 90*a* of a support member 90 at the middle of the carrier conveying pipe 49 so that the carrier conveying pipe 49 does not swing when rotated.

A rotational driving force is transferred to the carrier conveying pipe 49 via the gears 81 and 82. The carrier conveying pipe 49 is rotated with the spiral fin 50. The fin 50 is not fixed and is rotated in accordance with the rotation of the conveying pipe 49 by contacting a part of the conveying pipe 49 and getting a rotational force from the conveying pipe 49, as is shown in various embodiments illustrated by FIGS. 6A-6D. Further, the fin 50 is rotated in accordance with the rotation of the conveying pipe 49. Therefore, the rotation speed of the fin 50 and the conveying pipe 49 are the same in this embodiment. Thus, the carrier C is conveyed from the transit member 71 to the carrier compensating port 23*m*. The carrier C is moved in a direction shown by an arrow in FIG. 6A.

The magnet 70 is arranged underneath the carrier conveying pipe 49 to form a magnetic field inside the carrier conveying pipe 49. The carrier C is affected by the magnetic field formed by the magnet 70 so that the carrier C is efficiently conveyed.

The magnet 70 is provided in a whole area of an inclined conveying path of the carrier conveying pipe 49. As a result, it is possible to prevent the performance of the conveyance from declining. Namely, it is possible to avoid the carrier C slipping and dropping in the inclined conveying path of the carrier conveying pipe 49. The magnet 70 may be arranged along the carrier conveying pipe 49 and may be arranged to trace a curved shape of the carrier conveying pipe 49.

Figure 7A:
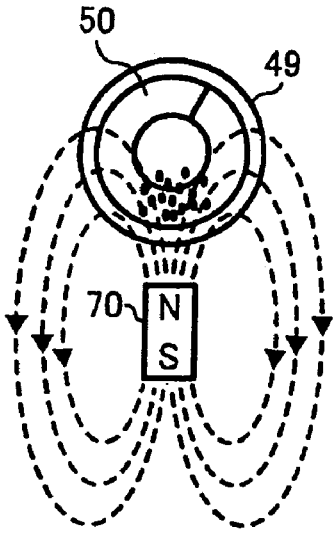
FIGS. 7A and 7B illustrate magnetic fields formed towards the carrier conveying pipe.

A magnetic field is formed by the magnet 70 radially towards a center of the carrier conveying pipe 49 as shown by a dotted arrow in FIG. 7A. Strong magnetic fluxes are passing through the carrier conveying pipe 49 so that a suction force applied to the carrier C increases. As a result, a conveying efficiency of the carrier is improved.

Due to the magnetic flux of the magnet 70, the carrier C is fully stirred by a binding force which works to form spikes of the carrier moving in the carrier conveying pipe 49. This stirring activity is especially useful in the carrier conveying mechanism which conveys the two-component developer.

Figure 7B:
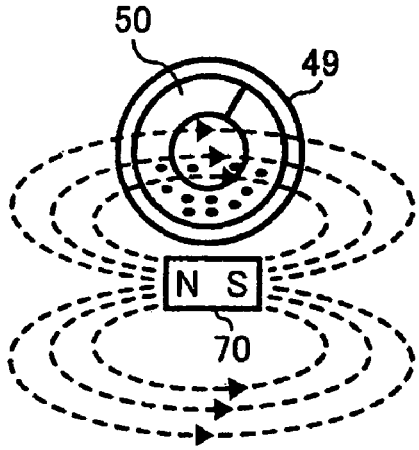

On the contrary, if a magnetic field is formed in a direction tangentially to the carrier conveying pipe 49 as shown by a dotted arrow in FIG. 7B, the suction force applied to the carrier C decreases and the spikes of the carrier by the binding force may not be formed. As a result, the carrier forms clods and the clods of the carrier are conveyed in the carrier conveying pipe 49. The efficiency of the carrier conveyed then decreases.

Figure 8:
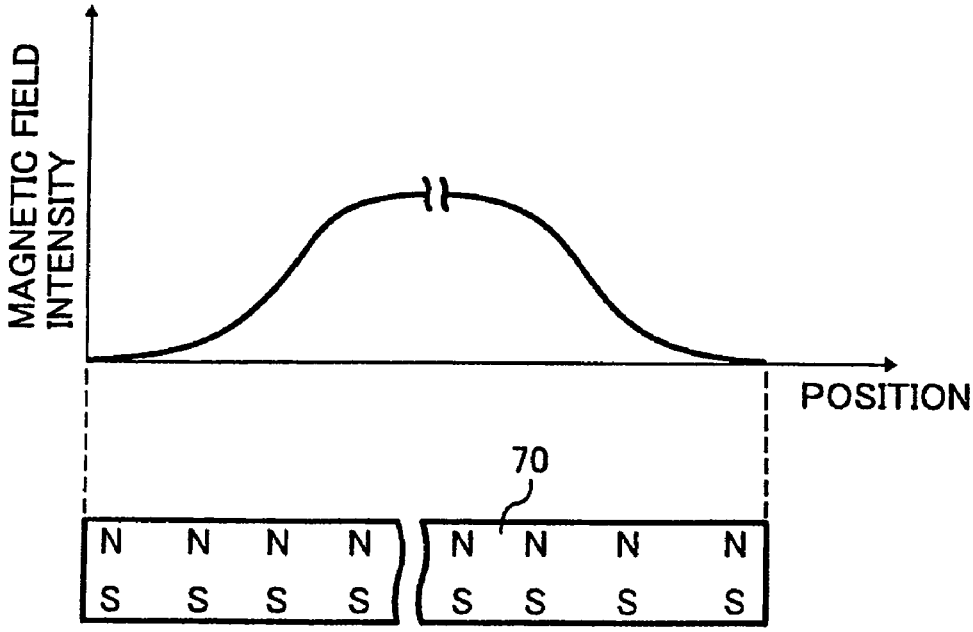
FIG. 8 is a graph illustrating a distribution of a magnetic field intensity in the carrier conveying pipe.

FIG. 8 is a graph illustrating a distribution of magnetic field intensities in the carrier conveying pipe 49. The magnet 70 is formed to have lower magnetic intensities at positions upstream and downstream from a middle position along a conveying direction (longitudinal direction) of the carrier conveying pipe 49 than a magnetic intensity in the middle of the carrier conveying pipe 49.

More specifically, referring to FIG. 5, at the inclined path of the carrier conveying pipe 49, the magnetic field intensities at the position upstream (lower position) and downstream (higher position) are made to be smaller than the magnetic intensity at the middle position. The guide member 90*a* is arranged near the middle position of the carrier conveying pipe 49.

According to this configuration, it is possible to avoid a failure of the conveyed carrier due to a larger suction force by the magnet 70 than the carrier conveying force by the spiral fin 50 at the position downstream of the carrier conveying pipe 49. Namely, the carrier C is smoothly conveyed along a horizontal path of the carrier conveying pipe 49 by the carrier conveying force by the spiral fin 50 at the position downstream of the carrier conveying pipe 49 because the binding force by the magnet 70 is decreased.

At the position upstream of the carrier conveying pipe 49, the suction force by the magnet 70 is made small so that the carrier C is smoothly brought into the inclined path from a horizontal path of the carrier conveying pipe 49.

The carrier conveying pipe 49 and the spiral fin 50 may have a variety of types other than the example shown in FIG. 6A.

Figure 6B:
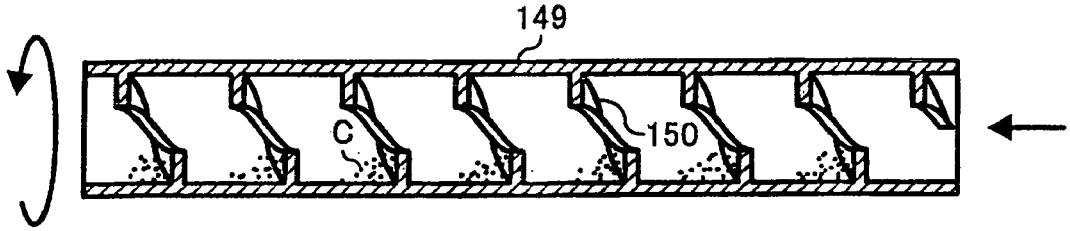

FIG. 6B illustrates another carrier conveying pipe 149 integrated with a spiral fin 150 at the inner circumference of the carrier conveying pipe 149 by using a rubber material and a resin material.

Figure 6C:
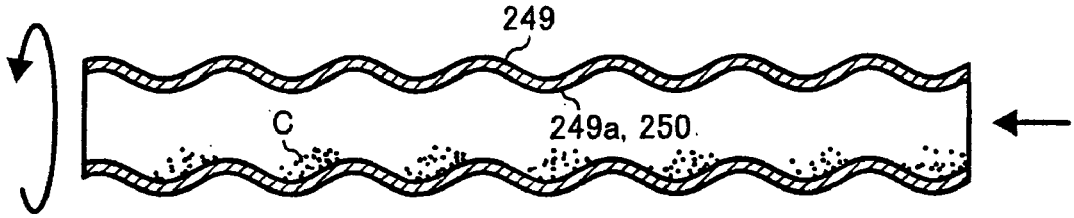

FIG. 6C illustrates another carrier conveying pipe 249 which is a tube having a rippling shape like a threaded rod. A threaded portion 249*a*, which works as spiral member, is formed and is integrated with the carrier conveying pipe 249 at the inner circumference of the carrier conveying pipe 249.

Figure 6D:
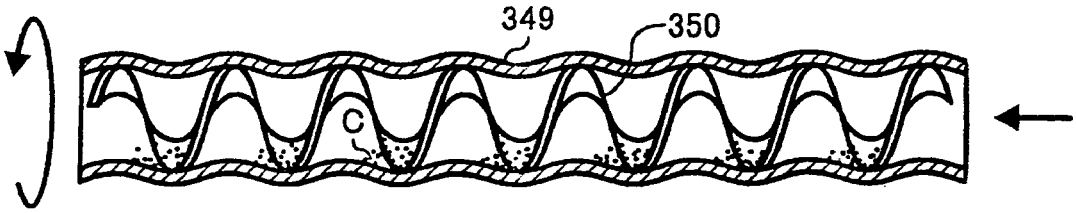

FIG. 6D illustrates another carrier conveying pipe 349 which is formed of a heat-shrinkable tube. The heat-shrinkable tube is placed to cover the outer circumference of the spiral fin 350 with a predetermined distance. Then, the heat-shrinkable tube is contacted to the spiral fin 350 by applying heat. The spiral fin 350 is formed to contact the carrier conveying pipe 349 with no space in this exemplary embodiment.

Namely, it is possible to prevent the carrier from slipping and dropping in the inclined conveying path of the carrier conveying pipe. However, if an angle of the inclined path exceeds 30 degree, the carrier conveying efficiency is rapidly decreased because of a reduction of the amount of the carrier to be held by each part of the spiral fin.

If the magnetic field is applied to the carrier being conveyed in the carrier conveying path, each part of the spiral fin can hold the carrier with a predetermined amount. As a result, it is possible to avoid the degradation of the carrier conveying efficiency.

According to an embodiment of the present invention, the developer conveying apparatus may include a magnet 170 underneath the developer conveying pipe 44 (developer correcting path). The two-component developer G is affected by the magnetic field formed by the magnet 170 and is accelerated to form spikes. As a result, the conveying efficiency of the developer is improved.

According to this exemplary embodiment, each conveying path 44 and 49 includes a spiral member and the conveying path is rotated with the spiral member. Additionally, the magnetic field affects the carrier or the developer. As a result, the carrier or the developer is efficiently conveyed against the gravitational force with a relatively simple configuration even if the conveying path 44, 49 is inclined.

It is described in this exemplary embodiment that the new carrier is supplied from the carrier supply unit 47. The new two-component developer may be supplied from the carrier supply unit 47 instead of the new carrier.

In this exemplary embodiment, the developer conveying mechanism which conveys the carrier and the new two-component developer is described. The disclosure can be applied to other conveying mechanism which conveys the toner which is affected by the magnetic field.

The carrier conveying pipe 49, which includes the spiral member 50, is rotated together with the spiral member 50 in the carrier conveying pipe 49 in this exemplary embodiment. The spring member arranged in the conveying pipe 49 may only be rotated. Further, the magnet 70 may be arranged along an inclined conveying path of a carrier conveying mechanism even if the carrier conveying mechanism uses an air pump to send air to convey the carrier against the gravitational force.

Each process cartridge 20Y, 20M, 20C and 20BK, the photosensitive drum 21, the charging unit 22 and the cleaning unit 25 are integrated and each developer unit 23Y, 23M, 23C and 23BK is provided as a separate unit in this exemplary embodiment. However, each developer unit 23Y, 23M, 23C and 23BK may be integrated in each process cartridge 20Y, 20M, 20C and 20BK. Namely, the process cartridge 20 may include the photosensitive drum 21, the charging unit 22, the developer unit 23 and the cleaning unit 25.

Numerous additional modifications and variations are possible in light of the above teachings. It is therefore to be understood that within the scope of the appended claims, the disclosure of this patent specification may be practiced otherwise than as specifically described herein.

What is claimed is:

1. An image forming apparatus, comprising:

a conveying pipe, at least a portion of which is an inclined path, configured to convey a developer; and a magnetic field generation mechanism, arranged along the inclined path of the conveying pipe, and configured to generate a magnetic field inside the conveying pipe to convey the developer up the inclined path;

a spiral member arranged in the conveying pipe, wherein the conveying pipe is driven to rotate and the spiral member is configured to be rotated in accordance with the rotation of the conveying pipe, wherein:

the spiral member includes a spiral edge which is arranged at a predetermined distance from an inner circumference of the conveying pipe, and the predetermined distance is between zero and five times a particle size of a carrier of the developer.

2. The image forming apparatus according to claim 1, wherein the spiral member is integrally formed with an inner circumference of the conveying pipe.

3. The image forming apparatus according to claim 1, wherein the magnetic field generation mechanism includes a magnet arranged underneath the conveying pipe.

4. The image forming apparatus according to claim 3, wherein the conveying pipe is flexible.

5. The image forming apparatus according to claim 3, wherein the magnetic field generation mechanism generates the magnetic field radially towards a center of the conveying pipe.

6. The image forming apparatus according to claim 1, wherein the conveying pipe is formed of a nonmagnetic material.

7. The image forming apparatus according to claim 1, further comprising:

an image carrier configured to form a latent image;

a developer storage configured to store the developer; and a development unit configured to develop the latent image formed on the image carrier, wherein the developer is conveyed in the conveying pipe from the developer storage to the development unit.

8. An image forming apparatus comprising, a conveying pipe, at least a portion of which is an inclined path, configured to convey a developer; and a magnetic field generation mechanism, arranged along the inclined path of the conveying pipe, and configured to generate a magnetic field inside the conveying pipe to convey the developer up the inclined path, wherein:

the magnetic field generation mechanism includes a magnet arranged underneath the conveying pipe, and the magnet is formed to have lower magnetic intensities at positions upstream and downstream from a middle position of the conveying pipe along a conveying direction of the conveying pipe than a magnetic intensity in the middle of the conveying pipe.

9. An image forming apparatus, comprising:

a conveying pipe, at least a portion of which is an inclined path, configured to convey a developer;

a magnetic field generation mechanism, arranged along the inclined path of the conveying pipe, and configured to generate a magnetic field inside the conveying pipe to convey the developer up the inclined path;

an image carrier configured to form a latent image;

a development unit configured to develop the latent image formed on the image carrier;

an outputting mechanism configured to output a part of the developer stored in the development unit; and a developer correcting unit configured to correct the developer output from the outputting mechanism, wherein the developer is conveyed to the developer correcting unit by the conveying pipe.

10. An image forming apparatus, comprising:

a conveying pipe, at least a portion of which is an inclined path, configured to convey a developer and to be rotated;

a magnetic field generation mechanism, arranged along an inclined path of the conveying pipe, and configured to generate a magnetic field inside the conveying pipe to convey the developer up the inclined path;

a spiral member arranged in the conveying pipe, wherein the conveying pipe is driven to rotate and the spiral member is configured to be rotated with the rotation of the conveying pipe, an image carrier configured to form a latent image;

a development unit configured to develop the latent image formed on the image carrier;

an outputting mechanism configured to output a part of the developer stored in the development unit; and a developer correcting unit configured to correct the developer output from the outputting mechanism, wherein the developer is conveyed to the developer correcting unit by the conveying pipe.

11. The image forming apparatus according to claim 10, wherein the spiral member includes a spiral edge which is arranged at a predetermined distance from an inner circumference of the conveying pipe.

12. The image forming apparatus according to claim 10, wherein the spiral member is integrally formed with the inner circumference of the conveying pipe.

13. The image forming apparatus according to claim 10, wherein the conveying pipe is formed of a nonmagnetic material.

14. The image forming apparatus according to claim 10, further comprising:

a developer storage configured to store the developer, wherein the developer is conveyed in the conveying pipe from the developer storage to the development unit.

15. An image forming apparatus, comprising:

a conveying pipe, at least a portion of which is an inclined path, configured to convey a developer and to be rotated;

a magnetic field generation mechanism, arranged along an inclined path of the conveying pipe, and configured to generate a magnetic field inside the conveying pipe to convey the developer up the inclined path; and a spiral member arranged in the conveying pipe, wherein the conveying pipe is driven to rotate and the spiral member is configured to be rotated with the rotation of the conveying pipe, wherein:

the spiral member includes a spiral edge which is arranged at a predetermined distance from an inner circumference of the conveying pipe, and the predetermined distance is between zero and five times a particle size of a carrier of the developer.

* * * * *